US007896962B2

(12) United States Patent
Kool et al.

(10) Patent No.: US 7,896,962 B2
(45) **Date of Patent: *Mar. 1, 2011**

(54) ALUMINIZING SLURRY COMPOSITIONS FREE OF HEXAVALENT CHROMIUM, AND RELATED METHODS AND ARTICLES

(75) Inventors: Lawrence Bernard Kool, Clifton Park, NY (US); Michael Francis Gigliotti, Jr., Scotia, NY (US); Stephen Francis Rutkowski, Duanesburg, NY (US); Paul Steven Svec, Scotia, NY (US); Anatoli Kogan, Clifton Park, NY (US); Richard DiDomizio, Latham, NY (US); Brian Stephen Noel, Morrow, OH (US); David Carr, Taylor, SC (US); William Randall Thompson, Greenville, SC (US)

(73) Assignee: General Electric Company, Niskayuna, NY (US)

( * ) Notice: Subject to any disclaimer, the term of this patent is extended or adjusted under 35 U.S.C. 154(b) by 118 days.

This patent is subject to a terminal disclaimer.

(21) Appl. No.: 11/840,635

(22) Filed: Aug. 17, 2007

(65) Prior Publication Data

US 2007/0287013 A1 Dec. 13, 2007

Related U.S. Application Data

(62) Division of application No. 10/633,888, filed on Aug. 4, 2003, now Pat. No. 7,270,852.

(51) Int. Cl.
*C04B 12/04* (2006.01)

(52) U.S. Cl. ..... 106/600; 106/603

(58) Field of Classification Search ..... 106/600, 106/603

See application file for complete search history.

(56) References Cited

U.S. PATENT DOCUMENTS

| | | | | |
|---|---|---|---|---|
| 3,248,251 | A | 4/1966 | Allen | |
| 3,721,574 | A * | 3/1973 | Schneider et al. | 106/623 |
| 4,027,073 | A | 5/1977 | Clark | |
| 4,229,495 | A * | 10/1980 | Takahashi et al. | 138/145 |
| 4,479,824 | A * | 10/1984 | Schutt | 106/14.21 |
| 5,041,309 | A | 8/1991 | Davis et al. | |
| 5,043,378 | A | 8/1991 | Packer et al. | |
| 5,102,700 | A | 4/1992 | Baldi | |
| 5,318,850 | A | 6/1994 | Pickett et al. | |
| 5,399,313 | A | 3/1995 | Ross et al. | |
| 5,650,235 | A | 7/1997 | McMordie et al. | |
| 5,759,932 | A | 6/1998 | Sangeeta et al. | |
| 6,074,464 | A | 6/2000 | Eddinger et al. | |
| 6,086,997 | A | 7/2000 | Patel et al. | |
| 6,150,033 | A | 11/2000 | Mosser et al. | |
| 6,224,657 | B1 | 5/2001 | Myers et al. | |
| 6,368,394 | B1 | 4/2002 | Hughes et al. | |
| 6,372,299 | B1 | 4/2002 | Thompson et al. | |
| 6,428,630 | B1 | 8/2002 | Mor et al. | |
| 7,138,184 | B2 * | 11/2006 | Clerici et al. | 428/447 |
| 7,332,024 | B2 * | 2/2008 | Kool | 106/287.17 |
| 2003/0152705 | A1 | 8/2003 | Pfaendtner et al. | |
| 2005/0031877 | A1 | 2/2005 | Gigliotti, Jr. et al. | |

FOREIGN PATENT DOCUMENTS

EP 0295834 * 12/1988

OTHER PUBLICATIONS

JP 02000026979 A (Fuji et al.) Jan. 25, 2000 abstract only.*
JP 02004359811 A (Kaneko) Dec. 2004 abstract only.*
JP 3636203 B1 (Yuken Kogyo Co. LTD) Apr. 2005 abstract only.*
PL 154952 (Kielska et al.) Oct. 1991 abstract only.*

* cited by examiner

*Primary Examiner*—Paul Marcantoni
(74) *Attorney, Agent, or Firm*—Francis T. Coppa

(57) ABSTRACT

A slurry coating composition is described, which is very useful for enriching the surface region of a metal-based substrate with aluminum. The composition includes colloidal silica and particles of an aluminum-based powder, and is substantially free of hexavalent chromium. The slurry may include colloidal silica and an alloy of aluminum and silicon. Alternatively, the slurry includes colloidal silica, aluminum or aluminum-silicon, and an organic stabilizer such as glycerol. The slurry exhibits good thermal and chemical stability for extended periods of time, making it very useful for industrial applications. Related methods and articles are also described.

26 Claims, No Drawings

ALUMINIZING SLURRY COMPOSITIONS FREE OF HEXAVALENT CHROMIUM, AND RELATED METHODS AND ARTICLES

This application is a divisional application of application Ser. No. 10/633,888, filed Aug. 4, 2003.

BACKGROUND OF THE INVENTION

This invention relates generally to coating systems for protecting metals. More specifically, it is directed to slurry coating compositions for providing aluminum enrichment to the surface region of a metal substrate.

Many types of metals are used in industrial applications. When the application involves demanding operating conditions, specialty metals and alloys are often required. As an example, components within gas turbine engines operate in a high-temperature environment. The specialty alloys must withstand in-service temperatures in the range of about 650° C.-1200° C. Moreover, the alloys may be subjected to repeated temperature cycling, e.g., exposure to high temperatures, followed by cooling to room temperature, and then followed by rapid re-heating.

In the case of turbine engines, the substrate is often formed from a nickel-base or cobalt-base superalloy. The term "superalloy" is usually intended to embrace complex cobalt- or nickel-based alloys which include one or more other elements such as aluminum, tungsten, molybdenum, titanium, and iron. The quantity of each element in the alloy is carefully controlled to impart specific characteristics, e.g., environmental resistance and mechanical properties such as high-temperature strength. Aluminum is a particularly important component for many superalloys. It imparts environmental resistance to the alloys, and can also improve their precipitation-strengthening.

Superalloy substrates are often coated with protective metallic coatings. One example of the metallic coating is an MCrAl(X)-type material, where M is nickel, cobalt, or iron; and X is an element selected from the group consisting of Y, Ta, Si, Hf, Ti, Zr, B, C, and combinations thereof. Another type of protective metallic coating is an aluminide material, such as nickel-aluminide or platinum-nickel-aluminide.

If the superalloy is exposed to an oxidizing atmosphere for an extended period of time, it can become depleted in aluminum. This is especially true when the particular superalloy component is used at the elevated temperatures described above. The aluminum loss can occur by way of various mechanisms. For example, aluminum can diffuse into the overlying protective coating; be consumed during oxidation of the protective coating; or be consumed during oxidation at the coating/substrate interface.

Since loss of aluminum can be detrimental to the integrity of the superalloy, techniques for countering such a loss have been investigated. At elevated temperatures, the substrate can be partially replenished with aluminum which diffuses from an adjacent MCrAlX coating. However, the amount of aluminum diffusion into the substrate from the MCrAlX coating may be insufficient.

One method for increasing the aluminum content of the superalloy substrate (i.e., in its surface region) is sometimes referred to in the art as "aluminiding" or "aluminizing". In such a process, aluminum is introduced into the substrate by a variety of techniques. In the "pack aluminiding" process, the substrate is immersed within a mixture (or pack) containing the coating element source, filler material, and a halide activating agent. At high temperatures (usually about 700-750° C.), reactions within the mixture yield an aluminum-rich vapor which condenses onto the substrate surface. During a subsequent heat treatment, the condensed aluminum-based material diffuses into the substrate.

Slurry compositions are employed in another method for incorporating aluminum into the surface of a superalloy. For example, an aqueous or organic slurry containing aluminum in some form can be sprayed or otherwise coated onto the substrate. The volatile components are then evaporated, and the aluminum-containing component can be heated in a manner which causes the aluminum to diffuse into the substrate surface.

Important advantages are associated with using slurries for aluminizing the substrates. For example, slurries can be easily and economically prepared, and their aluminum content can be readily adjusted to meet the requirements for a particular substrate. Moreover, the slurries can be applied to the substrate by a number of different techniques, and their wetting ability helps to ensure relatively uniform aluminization.

Slurry compositions which contain aluminum are described, for example, in U.S. Pat. No. 3,248,251 (Allen). The aluminum particulates in the patent are dispersed in an aqueous, acidic bonding solution which also contains metal chromate, dichromate or molybdate, and phosphate. (The phosphate serves as a binder). The chromate ions are known to improve corrosion resistance. One prevalent theory described in U.S. Pat. No. 6,074,464 is that the chromate ions passivate the bonding solution toward aluminum, and inhibit the oxidation of metallic aluminum. This allows particulate aluminum to be combined with the bonding solution, without the undesirable reaction between the solution and the aluminum. The coatings described in the Allen patent are known to very effectively protect some types of metal substrates from oxidation and corrosion, particularly at high temperatures.

While the "Allen" compositions are useful for some applications, they have some disadvantages as well. One serious deficiency is that the compositions rely on the presence of chromates, which are considered toxic. In particular, hexavalent chromium is also considered to be a carcinogen. When compositions containing this form of chromium are used (e.g., in spray booths), special handling procedures have to be very closely followed, in order to satisfy health and safety regulations. The special handling procedures can often result in increased costs and decreased productivity.

Attempts have been made to formulate slurry compositions which do not rely on the presence of chromates. For example, U.S. Pat. No. 6,150,033 describes chromate-free coating compositions which are used to protect metal substrates such as stainless steel. Many of the compositions are based on an aqueous phosphoric acid bonding solution, which comprises a source of magnesium, zinc, and borate ions. The coatings are said to be very satisfactory, in terms of oxidation- and corrosion resistance.

However, the chromate-free slurry compositions may be accompanied by other serious drawbacks. For example, they are sometimes unstable over the course of several hours (or even several minutes), and may also generate unsuitable levels of gasses such as hydrogen. Furthermore, the compositions have been known to thicken or partially solidify during those time periods, making them very difficult to apply to a substrate, e.g., by spray techniques.

Moreover, the use of phosphoric acid in the compositions may also contribute to their instability. This is especially true when chromate compounds are not present, since the latter apparently passivate the surface of the aluminum particles. In the absence of the chromates, any phosphoric acid present may attack the aluminum metal in the slurry composition, rendering it thermally and physically unstable. At best, such a slurry composition will be difficult to store and apply to a substrate.

It is thus apparent that new slurry compositions useful for aluminizing metal substrates would be welcome in the art. The compositions should be capable of incorporating as much aluminum as necessary into the substrate. They should also be substantially free of chromate compounds—especially hexavalent chromium. (In some preferred embodiments, the compositions should also contain relatively low levels of phosphoric acid, e.g., less than about 10% by weight).

Moreover, these improved slurry compositions should be chemically and physically stable for extended periods of use and storage, as compared to the prior art. They should also be amenable to slurry-application by various techniques, such as spraying, painting, and the like. Furthermore, the use of these compositions should be generally compatible with other techniques which might be used to treat a particular metal substrate, e.g., a superalloy component.

BRIEF DESCRIPTION OF THE INVENTION

A slurry coating composition is described herein, which is very useful for enriching the surface region of a metal-based substrate with aluminum. The composition includes colloidal silica and particles of an aluminum-based powder. The aluminum-based powder usually has an average particle size in the range of about 0.5 micron to about 200 microns. (The powder is sometimes referred to herein as the "aluminum powder", for the sake of brevity). The composition is substantially free of hexavalent chromium, and contains, at most, restricted amounts of phosphoric acid.

In one embodiment, the slurry composition comprises colloidal silica and an alloy of aluminum and silicon. In another embodiment, the slurry composition comprises colloidal silica, aluminum or aluminum-silicon, and an organic stabilizer such as glycerol. The slurry composition is preferably aqueous, as defined below. The composition can be applied to the substrate by a number of techniques, but is often sprayed. As described below, the slurry composition exhibits good thermal and chemical stability for extended periods of time, making it very useful for industrial applications.

Another embodiment is directed to a method for aluminiding the surface region of a metal substrate. The method includes the following steps, using the types of slurry coatings described below:

(I) applying at least one layer of the slurry coating to the surface of the substrate; wherein the slurry coating is a composition which comprises colloidal silica and particles of an aluminum-based powder; and the aluminum-based powder has an average particle size in the range of about 0.5 micron to about 200 microns; and then (II) heat treating the slurry coating, under conditions sufficient to remove volatile components from the coating, and to cause diffusion of aluminum into the surface region of the substrate.

Still another embodiment is directed to an article, e.g., a superalloy substrate like those present in turbine alloy components. The substrate is covered by the aluminum-containing slurry coating described herein. The slurry coating is free of hexavalent chromium, and can be heated to diffuse the aluminum into the surface region of the substrate.

Other features and advantages of the present invention will be apparent from the following detailed description.

DETAILED DESCRIPTION OF THE INVENTION

As mentioned above, the slurry coating composition includes colloidal silica. The term "colloidal silica" is meant to embrace any dispersion of fine particles of silica in a medium of water or another solvent. (Water is usually preferred). Dispersions of colloidal silica are available from various chemical manufacturers, in either acidic or basic form. Moreover, various shapes of silica particles can be used, e.g., spherical, hollow, porous, rod, plate, flake, or fibrous, as well as amorphous silica powder. Spherical silica particles are often preferred. The particles usually (but not always) have an average particle size in the range of about 10 nanometers to about 100 nanometers. Non-limiting examples of references which describe colloidal silica are U.S. Pat. No. 4,027,073 and U.S. Pat. No. 5,318,850, which are incorporated herein by reference. Commercial examples of colloidal silica can be found under the trade names Ludox® and Remasol® (e.g., from Remet® Corporation, Utica, N.Y.).

The amount of colloidal silica present in the composition will depend on various factors. They include, for example: the amount of aluminum powder being used; and the presence (and amount) of an organic stabilizer, as described below. (It appears that the colloidal silica functions primarily as a very effective binder). Processing conditions are also a consideration, e.g., how the slurry is formed and applied to a substrate. Usually, the colloidal silica is present at a level in the range of about 5% by weight to about 20% by weight, based on silica solids as a percentage of the entire composition. In especially preferred embodiments, the amount is in the range of about 10% by weight to about 15% by weight.

The slurry coating composition further includes aluminum powder. This powder serves as the source of aluminum for the substrate. The aluminum powder can be obtained from a number of commercial sources, such as Valimet Corporation, Stockton, Calif. The powder is usually in the form of spherical particles. However, it can be in other forms as well, such as those described above for the colloidal silica, or in the form of a wire, e.g., wire mesh.

The aluminum powder can be used in a variety of standard sizes. The size of the powder particles will depend on several factors, such as the type of substrate; the technique by which the slurry is to be applied to the substrate; the identity of the other components present in the slurry; and the relative amounts of those components. Usually, the powder particles have an average particle size in the range of about 0.5 micron to about 200 microns. In some preferred embodiments, the powder particles have an average particle size in the range of about 1 micron to about 50 microns. In especially preferred embodiments, the average particle size is in the range of about 1 micron to about 20 microns. The powder particles are often produced by a gas atomization process, although other techniques can be employed, e.g., rotating electrode techniques.

As used herein, an "aluminum-based powder" is defined as one which contains at least about 75% by weight aluminum, based on total elements present. Thus, the powder may contain other elements which impart various characteristics to the substrate material, e.g., enhanced oxidation resistance, phase stability, environmental resistance, and sulfidation resistance. For example, the powder may contain at least one platinum group metal, such as platinum, palladium, ruthenium, rhodium, osmium, and iridium. Rare earth metals are also possible, e.g., lanthanides such as lanthanum, cerium, and erbium. Elements which are chemically-similar to the lanthanides could also be included, such as scandium and yttrium. In some instances, it may also be desirable to include one or more of iron, chromium, and cobalt. Moreover, those skilled in the art understand that aluminum powder may also contain various other elements and other materials at impurity levels, e.g., less than about 1% by weight. Techniques for preparing powders formed from any combination of the optional elements described above are also well-known in the art.

The composition of the aluminum-based powder, and the composition of the slurry, depend in large part on the amount of aluminum needed for the substrate. In general, the aluminum in the slurry coating composition will be present in an amount sufficient to compensate for any projected loss of aluminum from the substrate, under projected operating conditions. The operating condition parameters include temperature levels, temperature/time schedules and cycles; and environmental conditions. Data regarding loss of aluminum from a typical metal substrate exposed to the operating conditions of interest is readily obtainable, as described, for example, in U.S. Pat. No. 6,372,299 (A. M. Thompson et al). This patent is incorporated herein by reference.

Frequently, the amount of aluminum in the slurry composition is calculated to exceed the amount of aluminum present in the substrate itself (i.e., as formed) by up to about 65 atomic %. In terms of weight percentages, the amount of aluminum in the slurry is often in the range of about 0.5% by weight to about 45% by weight. In preferred embodiments, the amount of aluminum is in the range of about 30% by weight to about 40% by weight. (Depending on the particular requirements for the substrate, i.e., its surface region, these aluminum levels may be adjusted to allow for the presence of other metals intended for diffusion, as described herein).

In one embodiment of this invention, the aluminum is present in the form of an aluminum-silicon alloy. Frequently, the alloy is in powder form, and is available from companies like Valimet Corporation. Alloy powders of this type usually have a particle size in the range described above for the aluminum powders. They are often formed from a gas atomization process, as mentioned previously.

The silicon in the aluminum-silicon alloy serves, in part, to decrease the melting point of the alloy, thereby facilitating the aluminiding process, as described below. (It also appears that the silicon functions as a passivating agent, so that the alloy is relatively stable in the presence of the colloidal silica. However, the inventors do not wish to be bound by this theory). In some embodiments, the silicon is present in an amount sufficient to decrease the melting point of the alloy to below about 610° C. Usually, the silicon is present in the alloy at a level in the range of about 1% by weight to about 20% by weight, based on the combined weight of the silicon and aluminum. In some preferred embodiments, the silicon is present at a level in the range of about 10% by weight to about 15% by weight.

Table 1 describes some of the chemical and physical characteristics for several commercial grades of spherical, aluminum-silicon particles, available from Valimet Corporation. These grades of the aluminum-silicon alloy are merely exemplary, since many other types of these alloys could be used.

TABLE 1

| | WEIGHT % | |
|---|---|---|
| | S-10 GRADE | S-20 GRADE |
| Aluminum | Balance | Balance |
| Silicon | 11.0%-13.0% | 11.0%-13.0% |

TABLE 1-continued

| | WEIGHT % | |
|---|---|---|
| | S-10 GRADE | S-20 GRADE |
| Iron | 0.8% maximum | 0.8% maximum |
| Zinc | 0.2% maximum | 0.2% maximum |
| Oil and Grease | 0.2% maximum | 0.2% maximum |
| Volatile Components | 0.1% maximum | 0.1% maximum |
| SIEVE ANALYSIS | | |
| +140 | | 1.0% maximum |
| +170 | | 7.0% maximum |
| +200 | 0.1% maximum | |
| +250 | 1.0% maximum | |
| +325 | 15.0% maximum | 90.0% minimum |
| −325 | 85.0% minimum | 10.0% maximum |

As in the case of the powders described above, the aluminum-silicon alloys may also contain one or more other elements which impart a variety of desired characteristics. Examples include the platinum group metals; rare earth metals (as well as Sc and Y); iron, chromium, cobalt, and the like. Minor amounts of impurities are also sometimes present, as described previously.

In another embodiment, the slurry composition includes an organic stabilizer, in addition to the colloidal silica and the aluminum (or aluminum-silicon) component. The stabilizer is an organic compound which contains at least two hydroxyl groups. In some preferred embodiments, the stabilizer contains at least three hydroxyl groups. Stabilizers which are water-miscible are also sometimes preferred, although this is often not a critical requirement. Moreover, a combination of two or more organic compounds could be used as the stabilizer.

Many organic compounds can be used. Non-limiting examples include alkane diols (sometimes referred to as "dihydroxy alcohols") such as ethanediol, propanediol, butanediol, and cyclopentanediol. (Some of these dihydroxy alcohols are referred to as "glycols", e.g., ethylene glycol, propylene glycol, and diethylene glycol). The diols can be substituted with various organic groups, i.e., alkyl or aromatic groups. Non-limiting examples of the substituted versions include 2-methyl-1,2-propanediol; 2,3-dimethyl-2,3-butanediol; 1-phenyl-1,2-ethanediol; and 1-phenyl-1,2-propanediol.

Another example of the organic stabilizer is glycerol, $C_3H_5(OH)_3$. The compound is sometimes referred to as "glycerin" or "glycerine". Glycerol can readily be obtained from fats, i.e., glycerides.

Compounds containing greater than three hydroxy groups (some of which are referred to as "sugar alcohols") can also be used. As an example, pentaerythritol, $C(CH_2OH)_4$, can be a suitable stabilizer. Sorbitol and similar polyhydroxy alcohols represent other examples. Suitable compounds are also described in many standard texts. Examples include "Organic Chemistry", by Morrison and Boyd, 3rd Edition (1975); and "The Condensed Chemical Dictionary", Tenth Edition, Van Nostrand Reinhold Company (1981).

Various polymeric materials containing at least two hydroxy groups can also be employed as the organic stabilizer. Non-limiting examples include various fats (glycerides), such as phosphatidic acid (a phosphoglyceride). Carbohydrates represent another broad class of materials that may be employed. They are well-known in the art and described, for example, in the "Organic Chemistry" text mentioned above, pages 1070-1132. The term "carbohydrate" is meant to include polyhydroxy aldehydes, polyhydroxy ketones, or compounds that can be hydrolyzed to them. The term includes materials like lactose, along with sugars, such as glucose, sucrose, and fructose. Many related compounds could also be used, e.g., polysaccharides like cellulose and starch, or components within the polysaccharides, such as amylose. (Water-soluble derivatives of any of these compounds are also known in the art, and can be used herein).

Based on factors such as cost, availability, and effectiveness, glycerols and dihydroxy alcohols like the glycols are often preferred as the organic stabilizer. Although the inventors do not wish to be bound by any specific theory, it appears that the tri-hydroxy functionality of compounds like glycerol is especially effective at passivating the aluminum component in the slurry. (Compounds like glycerol, which contain three or more hydroxy groups, are sometimes referred to as "polyols").

The amount of the organic stabilizer which should be used will depend on various factors. They include: the specific type of stabilizer present; the hydroxyl content of the stabilizer; its water-miscibility; the effect of the stabilizer on the viscosity of the slurry composition; the amount of aluminum present in the slurry composition; the particle size of the aluminum; the surface-to-volume ratio of the aluminum particles; the specific technique used to prepare the slurry; and the identity of the other components which may be present in the slurry composition. (For example, if used in sufficient quantities, the organic stabilizer is capable of preventing or minimizing any undesirable reaction between the aluminum metal and phosphoric acid, when the latter is present).

In preferred embodiments, the organic stabilizer is present in an amount sufficient to chemically stabilize the aluminum or aluminum-silicon component during contact with water or any other aqueous components. The term "chemically stabilize" is used herein to indicate that the slurry remains substantially free of undesirable chemical reactions. These are reactions which would increase the viscosity and/or the temperature of the composition to unacceptable levels. For example, unacceptable increases in temperature or viscosity are those which could prevent the slurry composition from being easily applied to the substrate, e.g., by spraying.

As a very general guideline, compositions which are deemed to be unstable are those which exhibit a temperature increase of greater than about 10 degrees Centigrade within about 1 minute, or greater than about 30 degrees Centigrade within about 10 minutes. In the alternative (or in conjunction with the temperature increase), these compositions may also exhibit unacceptable increases in viscosity over the same time period. (As those skilled in the chemical arts understand, the increases in temperature and viscosity may begin to occur after a short induction period).

Usually, the amount of organic stabilizer present in the slurry composition is in the range of about 0.1% by weight to about 20% by weight, based on the total weight of the composition. In preferred embodiments, the range is about 0.5% by weight to about 15% by weight.

The slurry coating which contains the components described above can contain various other ingredients as well. Many of these are known in the art to those involved in slurry preparations. Slurries are generally described in "Kirk-Othmer's Encyclopedia of Chemical Technology", 3rd Edition, Vol. 15, p. 257 (1981), and in the 4th Edition, Vol. 5, pp. 615-617 (1993), as well as in U.S. Pat. Nos. 5,759,932 and 5,043,378. Each of these references is incorporated herein by reference. A good quality slurry is usually well-dispersed and free of air bubbles and foaming. It typically has a high specific gravity and good rheological properties adjusted in accordance with the requirements for the particular technique used to apply the slurry to the substrate. Moreover, the solid particle settling rate in the slurry should be as low as possible, or should be capable of being controlled, e.g., by stirring. The slurry should also be chemically stable.

As mentioned above, the slurry composition is preferably aqueous. In other words, it includes a liquid carrier which is primarily water, i.e., the medium in which the colloidal silica is often employed. As used herein, "aqueous" refers to compositions in which at least about 65% of the volatile components are water. Preferably, at least about 80% of the volatile components are water.

Thus, a limited amount of other liquids may be used in admixture with the water. Non-limiting examples of the other liquids or "carriers" include alcohols, e.g., lower alcohols with 1-4 carbon atoms in the main chain, such as ethanol. Halogenated hydrocarbon solvents are another example. Selection of a particular carrier composition will depend on various factors, such as: the evaporation rate required during treatment of the substrate with the slurry; the effect of the carrier on the adhesion of the slurry to the substrate; the solubility of additives and other components in the carrier; the "dispersability" of powders in the carrier; the carrier's ability to wet the substrate and modify the rheology of the slurry composition; as well as handling requirements; cost requirements; and environmental/safety concerns. Those of ordinary skill in the art can select the most appropriate carrier composition by considering these factors.

The amount of liquid carrier employed is usually the minimum amount sufficient to keep the solid components of the slurry in suspension. Amounts greater than that level may be used to adjust the viscosity of the slurry composition, depending on the technique used to apply the composition to a substrate. In general, the liquid carrier will comprise about 30% by weight to about 70% by weight of the entire slurry composition. (It should be noted that the slurry could be in the form of a "liquid-liquid emulsion").

A variety of other components may be used in the slurry coating composition. Most of them are well-known in areas of chemical processing and ceramics processing. Non-limiting examples of these additives are thickening agents, dispersants, deflocculants, anti-settling agents, anti-foaming agents, binders, plasticizers, emollients, surfactants, and lubricants. In general, the additives are used at a level in the range of about 0.01% by weight to about 10% by weight, based on the weight of the entire composition.

For embodiments in which the slurry composition is based on colloidal silica and the aluminum-silicon alloy, there are no critical steps in preparing the composition. Conventional blending equipment can be used, and the shearing viscosity can be adjusted by addition of the liquid carrier. Mixing of the ingredients can be undertaken at room temperature, or at temperatures up to about 60° C., e.g., using a hot water bath or other technique. Mixing is carried out until the resulting blend is uniform. (Portions of the primary ingredients may be withheld temporarily during the blending operation, to ensure intimate mixing). The additives mentioned above, if used, are usually added after the primary ingredients have been mixed, although this will depend in part on the nature of the additive.

For embodiments which utilize an organic stabilizer in conjunction with the aluminum-based powder and the colloidal silica, certain blending sequences are highly preferred in some instances. For example, the organic stabilizer is usually first mixed with the aluminum-based powder, prior to any significant contact between the aluminum-based powder and the aqueous carrier. A limited portion of the colloidal silica, e.g., one-half or less of the formulated amount, may also be included at this time (and added slowly), to enhance the shear characteristics of the mixture. The present inventors have discovered that the initial contact between the stabilizer and the aluminum, in the absence of a substantial amount of any aqueous component, greatly increases the stability of this type of slurry composition.

The remaining portion of the colloidal silica is then added and thoroughly mixed into the blend. The other optional additives can also be added at this time. In some instances, it may be desirable to wait for a period of time, e.g., up to about 24 hours or more, prior to adding the remaining colloidal silica. This waiting period may enhance the "wetting" of the alumina with the stabilizer, but does not always appear to be necessary. Those skilled in the art can determine the effect of the waiting period on slurry stability, without undue experimentation. Blending temperatures are as described above.

The sequence discussed above is very preferable for compositions which utilize the stabilizer. However, other techniques for mixing the ingredients may be possible. For example, if all of the primary ingredients are mixed together rapidly, then adverse reactions between the aluminum component and the colloidal silica could be prevented or minimized. However, the process should be monitored very closely for the occurrence of sudden increases in temperature and/or viscosity. Appropriate safeguards should be in place.

The slurry coating composition may be applied to various metal substrates. The use of this composition is especially advantageous for enhancing the aluminum content of superalloy substrates. The term "superalloy" is usually intended to embrace complex cobalt-, nickel-, or iron-based alloys which include one or more other elements, such as chromium, rhenium, aluminum, tungsten, molybdenum, and titanium. Superalloys are described in many references, e.g., U.S. Pat. No. 5,399,313, incorporated herein by reference. High temperature alloys are also generally described in "Kirk-Othmer's Encyclopedia of Chemical Technology", 3rd Edition, Vol. 12, pp. 417-479 (1980), and Vol. 15, pp. 787-800 (1981). The actual configuration of the substrate may vary widely. For example, the substrate may be in the form of various turbine engine parts, such as combustor liners, combustor domes, shrouds, buckets, blades, nozzles, or vanes.

The slurry coatings can be applied to the substrate by a variety of techniques known in the art. Some examples of the deposition techniques are described in "Kirk-Othmer's Encyclopedia of Chemical Technology", 4th Edition, Vol. 5, pp. 606-619 (1993). The slurries can be slip-cast, brush-painted, dipped, sprayed, poured, rolled, or spun-coated onto the substrate surface, for example.

Spray-coating is often the easiest way to apply the slurry coating to substrates such as airfoils. The viscosity of the coating can be readily adjusted for spraying, by varying the amount of liquid carrier used. Spraying equipment is well-known in the art. Any spray gun for painting should be suitable, including manual or automated spray gun models; air-spray and gravity-fed models, and the like. Non-limiting examples are described in U.S. Pat. No. 6,086,997, incorporated herein by reference. Examples of commercially-available spray equipment carry the trade names Binks, Grayco, DeVilbiss, and Paasche. Adjustment in various spray gun settings (e.g., for pressure and slurry volume) can readily be made to satisfy the needs of a specific slurry-spraying operation.

The slurry can be applied as one layer, or multiple layers. (Multiple layers may sometimes be required to deliver the desired amount of aluminum to the substrate). If a series of layers is used, a heat treatment can be performed after each layer is deposited, to accelerate removal of the volatile components. After the full thickness of the slurry has been applied, an additional, optional heat treatment may be carried out, to further remove volatile materials like the organic solvents and water. The heat treatment conditions will depend in part on the identity of the volatile components in the slurry. An exemplary heating regimen is about 5 minutes to about 120 minutes, at a temperature in the range of about 80° C. to about 200° C. (Longer heating times can compensate for lower heating temperatures, and vice versa).

The dried slurry is then heated to a temperature sufficient to diffuse the aluminum into the surface region of the substrate, i.e., into the entire surface region, or some portion thereof. As used herein, the "surface region" usually extends to a depth of about 200 microns into the surface, and more frequently, to a depth of about 75 microns into the surface. Those of skill in the art understand that an "aluminum-diffused surface region" for substrates like superalloys includes both an aluminum-enriched region closest to the surface, and an area of aluminum-superalloy interdiffusion immediately below the enriched region.

The temperature required for this aluminizing step (i.e., the diffusion temperature) will depend on various factors. They include: the composition of the substrate; the specific composition and thickness of the slurry; and the desired depth of enhanced aluminum concentration. Usually the diffusion temperature is within the range of about 650° C. to about 1100° C., and preferably, about 800° C. to about 950° C. These temperatures are also high enough to completely remove (by vaporization or pyrolysis) any organic compounds which are present, e.g., stabilizers like glycerol. The diffusion heat treatment can be carried out by any convenient technique, e.g., heating in an oven in a vacuum or under argon gas.

The time required for the diffusion heat treatment will depend on many of the factors described above. Generally, the time will range from about 30 minutes to about 8 hours. In some instances, a graduated heat treatment is desirable. As a very general example, the temperature could be raised to about 650° C., held there for a period of time, and then increased, in steps, to about to 850° C. Alternatively, the temperature could initially be raised to a threshold temperature like 650° C., and then raised continuously, e.g., 1° C. per minute, to reach a temperature of about 850° C. in 200 minutes. Those skilled in the general art (e.g., those who work in the area of pack-aluminizing) will be able to select the most appropriate time-temperature regimen for a given substrate and slurry.

EXAMPLES

The examples which follow are merely illustrative, and should not be construed to be any sort of limitation on the scope of the claimed invention.

Example 1

Sample A was a commercial slurry, outside the scope of the present invention. The slurry contained three primary components. The first component was an aluminum alloy powder which included silicon, and which had an average particle size of about 4 microns. The second component was chromic acid, while the third component was phosphoric acid. The acidic mixture comprised approximately 58% by weight of the total slurry. The chromic acid was in the form of a solution of chromium trioxide ($CrO_3$) and water. When incorporated into the slurry, the chromium exists in its hexavalent state, and the color of the solution ranges from orange to deep red, depending on the concentration of the metal. When aluminum is added to the acidic solution, the chromium is slowly reduced to its trivalent state ($Cr_2O_3$), resulting in a distinctive green color.

Sample B was a trial slurry material, also outside the scope of this invention. It was prepared by combining aluminum powder (4 micron average particle size) with 4 mL of orthophosphoric acid. The material did not contain any chromium component.

Sample A exhibited a relatively high degree of stability, i.e., exhibiting substantially no change in viscosity, intrinsic temperature, or appearance. (The sample had previously been stable for more than one year). In marked contrast, sample B was immediately unstable upon preparation. A reaction occurred after the ingredients were mixed, resulting in a temperature increase, from room temperature to more than 100° C., in less than one minute. As the reaction proceeded, a mushroom cloud of gray reactant rose over the top of the container and overflowed. Upon cooling, the remaining product was very tacky, with no evidence of the presence of aluminum. This example demonstrates the necessity of including some form of chromium as a passivating agent in aluminum-based slurries of the prior art.

Example 2

Samples C and D were aluminum-containing slurries which were free of any chromium component. The samples are outside the scope of the present invention, and were prepared according to the teachings of U.S. Pat. No. 6,368,394. The components for each sample are listed in Table 2:

TABLE 2

| Ingredient | Sample C | Sample D |
|---|---|---|
| Deionized Water | 40.0 mL | 40.0 mL |
| Phosphoric Acid (85%) | 6.70 mL | 9.20 mL |
| Boron Oxide | 0.85 g | 1.40 g |
| Aluminum Hydroxide | 4.10 g | 4.30 g |
| Zinc Oxide | — | 0.70 g |

For each sample, the ingredients listed above were combined, with stirring, to form suspensions. 10 mL of each suspension (slurry) was combined with 8 g of aluminum powder, having an average particle size of about 4 microns. After 6.5 minutes of standing, slurry C exhibited a significant temperature change, reaching 180° C. at the 8 minute mark. Sample D was audibly "fizzing" about 1 minute after the addition of the aluminum. Nine minutes after being mixed, sample D began to increase in temperature rapidly, reaching 140° C. at the 10 minute mark. Sample D was still fizzing 20 minutes after being mixed.

It was therefore apparent that both samples underwent significant reaction when the binding solution (phosphoric acid) was combined with the aluminum. The fact that both samples were made in small quantities leads one to predict that larger batches would probably produce more severe reactions, with more gas- and heat-generation. Neither slurry produced the mushroom cloud or tacky reaction product which occurred with sample B (Example 1). However, each sample had completely solidified in its container, after sitting overnight.

Four hours after mixing, sample D had significantly increased in viscosity. 10 mL of water were added to the sample, causing more bubbles and fizzing. Both of the samples were then allowed to sit for about one hour. Following that rest period, each sample was stirred again, and then applied with a paint brush to coupons formed from a nickel-based superalloy. (The coupons had previously been grit-blasted and washed with alcohol). Both samples exhibited a very acceptable viscosity for painting, and initially adhered well to the coupon. The samples were then allowed to air-dry overnight.

The samples were then cured, according to a three-step heating regimen: 60 minutes at 80° C.; then 30 minutes at 120° C.; followed by 60 minutes at 230° C. This curing cycle appeared to remove substantially all of the liquid material in each sample.

Both samples were then heat-treated in a vacuum, using the following heat treatment cycle:

1) Load each coupon into oven, slurry-side up;
2) Raise oven temperature to 650° C. (±5° C.), and hold for 15 minutes (±1 minute);
3) Increase temperature at 8° C. per minute (maximum rate), to 870° C. (±5° C.);
4) Hold at 870° C. (±5° C.) for 2 hours (±6 minutes); and
5) Furnace-cool each coupon.

Upon being removed from the oven, most of sample C was attached to the coupon. However, most of sample D had spalled off its coupon. There was thus a considerable difference in the final appearance of sample C, as compared to sample D. It appeared that the addition of zinc oxide to sample D adversely affected its high-temperature binding properties.

After the heat treatment, each sample (i.e., the coated coupon) was cross-sectioned to produce additional samples for optical analysis. Cross-sectional portions of sample C showed very little diffusion of the aluminum from the sample into the coupon, i.e., the substrate. However, sample D did exhibit a significant diffusion zone (about 75 microns into the coupon), even though a significant portion of the sample had lost its slurry coating through spallation. In each instance, it may be possible to prevent some of the spallation by using thinner slurry coatings. The thinner coatings may be able to better withstand the effects of the heat treatment process, and could possibly allow for better diffusion characteristics.

Additional, brief, short-term tests were conducted, in an attempt to assess the stability of these prior art, chromate-free compositions. In the first test, aluminum powder was simply combined with water in a container. Heat evolution was apparent within several hours. The material completely solidified in three days.

Another washing procedure was used in a second test. In this instance, aluminum powder was washed in chromic acid, decanted, and then placed in phosphoric acid. The mixture reacted violently within 5 minutes. In a third informal experiment, aluminum powder was mixed with phosphoric acid, and chromic acid was very quickly added to the mixture. The mixture appeared to be stable for approximately 1 week, after which the test was discontinued.

It is evident that the currently-known, chromate-free slurry compositions usually exhibit serious stability problems. Moreover, it can be difficult to apply the compositions to a substrate, and to maintain an adherent layer of the composition on the substrate during a heat treatment. Furthermore, the compositions may not be consistently capable of providing aluminum to the diffusion region of the substrate by way of a diffusion heat treatment.

Example 3

Sample E was a slurry composition within the scope of the present invention. The colloidal silica was Remasol® grade LP-30, having a concentration of 30% $SiO_2$ in water, with a particle size of 12-13 millimicrons. An aluminum-silicon alloy obtained from Read Chemical Company was also used:

grade S-10. As described in Table 1, this material contained 11-13% silicon. The average particle size was about 10 microns.

30 weight % of the LP-30 silica and 70 weight % of the aluminum-silicon alloy was added to a mixing vessel, and mixed at high speed for about 15 minutes. The resulting slurry was very stable, and did not exhibit any significant increase in temperature or viscosity after combination of the ingredients. (The material was mixed immediately before use, because settling can occur quickly).

The slurry was brushed onto the surface of a nickel-based superalloy coupon, using a paint brush. (The coupon had been previously grit-blasted and washed with alcohol). Two coats were applied, for a total thickness (wet) of about 125 microns.

The slurry was allowed to air-dry on the coupon. After being air-dried, the coated coupon was cured in an oven, according to this heating regimen: 80° C. for 30 minutes, followed by 260° C. for 30 minutes. The coated coupon was then diffusion heat-treated in a vacuum oven, at a temperature of about 870° C. The coupon was held at that temperature for 2 hours. There was no evidence of coating spallation.

After being oven-cooled, the coupon was cross-sectioned for analysis. The cross-section was examined by both light microscopy and scanning electron microscopy. The cross-section revealed an aluminum-enriched region on the surface of the coupon. The depth of the aluminum-enriched region was about 75 microns, as measured prior to the mechanical removal of any friable residue left behind after the heat treatment. The depth included an outer, "high-aluminum" region, and an inner region of aluminum-superalloy interdiffusion.

Other slurry compositions having the same contents as sample E were stored and monitored for stability. The compositions remained stable for at least 5 months, i.e., as long as monitoring had taken place.

Example 4

Sample F was a slurry composition within the scope of the present invention. The colloidal silica used in Example 3 was used here as well. In this example, an aluminum powder (obtained from Alfa Aesar) was used, rather than the aluminum-silicon alloy powder. The aluminum powder had an average particle size of about 10 microns. Moreover, in this experiment, glycerol (glycerine) was used as an organic stabilizer.

The overall composition of the slurry was as follows: 32 weight % of the LP-30 colloidal silica; 60 weight % of the aluminum powder, and 8 weight percent of the glycerol. (In one example, the actual ingredients were as follows: 32 g LP-30; 60 g aluminum powder; and 8 g glycerine).

The glycerol was combined with one-half of the formulated amount of LP-30 (i.e., 16 weight percent), and mixed for about 5 minutes. The aluminum powder was then added to the mixture, followed by additional mixing. A planetary mixer was used, and mixing was continued until a uniform paste was present. The remaining portion of LP-30 was then added, followed by mixing at high speed, using an air-driven drill press mixer. As in the case of sample E, the slurry was very stable, and did not exhibit any significant increase in temperature or viscosity after combination of the ingredients. (The material was mixed immediately before use, to prevent settling).

In this example, the slurry was air-sprayed onto the surface of a pre-treated, nickel-based superalloy coupon, using a conventional DeVilbiss spray gun. The average thickness (wet) was about 125 microns. The slurry was then allowed to air-dry on the coupon.

Following air-drying, the slurry was then cured in an oven, according to the same heating regimen described in Example 3. The coated coupon was then diffusion heat-treated in a vacuum oven, at a temperature of about 870° C. The coupon was held at that temperature for 2 hours. There was no evidence of coating spallation.

After being oven-cooled, the coupon was cross-sectioned for analysis, as in Example 3. The cross-section revealed an aluminum-enriched region on the surface of the coupon. The enriched region had a depth of about 100 microns, prior to removal of any friable residue. As in Example 3, the enriched region included an outer, "high-aluminum" region, and an inner region of aluminum-superalloy interdiffusion.

Sample F was stored after use, and its stability was monitored. It remained stable after at least 5 months, i.e., the limit of monitoring at that time.

It should be readily apparent that the compositions of this invention exhibit highly desirable stability characteristics. They are also very effective for aluminizing a metal substrate. Moreover, the compositions are substantially free of chromate compounds—especially hexavalent chromium. Furthermore, some preferred embodiments are directed to compositions which are also substantially free of phosphoric acid or its derivatives. This can also represent a distinct advantage, as alluded to above. (Other embodiments allow limited amounts of phosphoric acid, e.g., less than about 10% by weight, based on the weight of the entire composition).

This invention has been described according to specific embodiments and examples. However, various modifications, adaptations, and alternatives may occur to one skilled in the art, without departing from the spirit and scope of the claimed inventive concept. All of the patents, articles, and texts which are mentioned above are incorporated herein by reference.

What is claimed is:

1. A slurry coating composition for providing aluminum content to the surface region of a metal-based substrate, wherein the composition is free of hexavalent chromium, and comprises a liquid carrier, colloidal silica, particles of an aluminum-based powder, and at least one organic compound selected from the group consisting of propanediol, butanediol, cyclopentanediol, and a compound which contains at least three hydroxyl groups.

2. The composition of claim 1, wherein the aluminum-based powder has an average particle size in the range of about 0.5 micron to about 200 microns.

3. The composition of claim 1, wherein the aluminum-based powder comprises an alloy of aluminum and silicon.

4. The composition of claim 3, wherein the silicon is present in an amount sufficient to decrease the melting point of the aluminum-silicon alloy to below about 610° C.

5. The composition of claim 3, wherein the silicon is present at a level in the range of about 1% by weight to about 20% by weight, based on the combined weight of the silicon and aluminum.

6. The composition of claim 5, wherein the silicon is present at a level in the range of about 10% by weight to about 15% by weight, based on the combined weight of the silicon and aluminum.

7. The composition of claim 3, wherein the aluminum-silicon alloy comprises substantially spherical powder particles.

8. The composition of claim 1, wherein the liquid carrier is selected from the group consisting of water, alcohols, halogenated hydrocarbon solvents, and compatible mixtures thereof.

9. The composition of claim 8, further comprising at least one additive selected from the group consisting of thickening agents, dispersants, deflocculants, anti-settling agents, anti-foaming agents, binders, plasticizers, emollients, surfactants, and lubricants.

10. The composition of claim 1, containing less than about 10% by weight of phosphoric acid and phosphoric acid derivatives, based on the weight of the entire composition.

11. An aqueous-based slurry coating composition according to claim 1.

12. The composition of claim 1, wherein the colloidal silica is present at a level in the range of about 5% by weight to about 20% by weight, based on silica solids as a percentage of the entire composition.

13. The composition of claim 1, wherein the amount of aluminum in the slurry composition exceeds the amount of aluminum present in the substrate by up to about 65 atomic %.

14. The composition of claim 1, wherein the aluminum-based powder further comprises at least one metal selected from the group consisting of platinum group metals, rare earth metals, scandium, yttrium, iron, chromium, and cobalt.

15. The composition of claim 1, wherein the silica in the colloidal silica has an average particle size in the range of about 10 nanometers to about 100 nanometers.

16. The composition of claim 1, wherein the organic compound is selected from the group consisting of glycerol, pentaerythritol, fats, and carbohydrates.

17. The composition of claim 16, wherein the carbohydrate is a sugar compound.

18. The composition of claim 1, wherein the organic compound is present in an amount sufficient to chemically stabilize the aluminum-based powder during contact with any aqueous component present in the composition.

19. The composition of claim 1, wherein the organic compound is present at a level in the range of about 0.1% by weight to about 20% by weight, based on the total weight of the composition.

20. A slurry coating composition for providing aluminum to the surface region of a turbine component formed from a material comprising a nickel-based superalloy, wherein the composition is free of hexavalent chromium, and comprises a liquid carrier, colloidal silica and particles of an aluminum-silicon alloy which has an average particle size in the range of about 1 micron to about 50 microns.

21. The composition of claim 20, wherein the colloidal silica is present at a level in the range of about 5% by weight to about 20% by weight, based on silica solids as a percentage of the entire composition; and the amount of aluminum in the composition exceeds the amount of aluminum present in the surface region of the component by up to about 65 atomic %.

22. A slurry coating composition for providing aluminum to the surface region of a turbine component formed from a material comprising a nickel-based superalloy, wherein the composition is free of hexavalent chromium, and comprises a liquid carrier, colloidal silica; an organic stabilizer selected from the group consisting of propanediol, butanediol, cyclopentanediol, and a compound which contains at least three hydroxyl groups; and particles of an aluminum-based powder which has an average particle size in the range of about 1 micron to about 50 microns.

23. The composition of claim 22, wherein the organic stabilizer is glycerol.

24. The composition of claim 22, wherein the aluminum-based powder comprises an alloy of aluminum and silicon.

25. The composition of claim 22, wherein the organic stabilizer is present at a level in the range of about 0.1% by weight to about 20% by weight, based on the total weight of the composition;

the colloidal silica is present at a level in the range of about 5% by weight to about 20% by weight, based on silica solids as a percentage of the entire composition; and the amount of aluminum in the composition exceeds the amount of aluminum present in the surface region of the component by up to about 65 atomic %.

26. A slurry coating composition for providing aluminum content to the surface region of a metal-based substrate, wherein the composition is free of hexavalent chromium, and comprises a liquid carrier, colloidal silica, and particles of an aluminum-based powder, wherein the aluminum-based power itself comprises an alloy of aluminum and silicon.

* * * * *